US009005371B2

(12) United States Patent
Egger et al.

(10) Patent No.: US 9,005,371 B2
(45) Date of Patent: Apr. 14, 2015

(54) DOMESTIC APPLIANCE, IN PARTICULAR DISHWASHER

(75) Inventors: Gerhard Egger, Altenmünster (DE); Norbert Gerstner, Herbrechtingen (DE); Bernd Schessl, Dillingen (DE); Rainer Schilling, Bachhagel (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 986 days.

(21) Appl. No.: 13/132,324

(22) PCT Filed: Nov. 30, 2009

(86) PCT No.: PCT/EP2009/066013

§ 371 (c)(1),
(2), (4) Date: Jun. 2, 2011

(87) PCT Pub. No.: WO2010/069738

PCT Pub. Date: Jun. 24, 2010

(65) Prior Publication Data

US 2011/0247276 A1 Oct. 13, 2011

(30) Foreign Application Priority Data

Dec. 19, 2008 (DE) ..... 10 2008 055 029

(51) Int. Cl.
*A47L 15/42* (2006.01)

(52) U.S. Cl.
CPC ..... *A47L 15/4257* (2013.01); *A47L 15/4293* (2013.01)

(58) Field of Classification Search
CPC ..... F17C 3/02
See application file for complete search history.

(56) References Cited

U.S. PATENT DOCUMENTS

| | | | |
|---|---|---|---|
| 5,174,618 | A | 12/1992 | Kropf |
| 2003/0168080 | A1 | 9/2003 | Raches |

FOREIGN PATENT DOCUMENTS

| | | | |
|---|---|---|---|
| CN | 1382950 | A | 12/2002 |
| CN | 1746601 | A | 3/2006 |
| CN | 1804523 | A | 7/2006 |
| DE | 19907233 | A1 | 8/2000 |
| DE | 10133766 | A1 | 1/2003 |

OTHER PUBLICATIONS

International Search Report PCT/EP2009/066013.
National Search Report DE 10 2008 055 029.9.
Report of Examination Including National Search Report CN 200980151155.2 dated Nov. 30, 2012.

*Primary Examiner* — Jason Ko
(74) *Attorney, Agent, or Firm* — James E. Howard; Andre Pallapies

(57) ABSTRACT

A domestic appliance, in particular a dishwasher, includes an appliance door which has a front operating panel with a handle shell which is formed at least from a bottom handle-shell part and a handle-shell cover. The handle-shell cover has a side wall which is directed towards the front operating panel and, together with the front operating panel, forms a double-wall structure with a free installation space arranged therebetween.

22 Claims, 5 Drawing Sheets

DOMESTIC APPLIANCE, IN PARTICULAR DISHWASHER

BACKGROUND OF THE INVENTION

The invention relates to a domestic appliance, in particular a dishwasher.

Dishwashers usually have on their front side an appliance door that can be swung open around a horizontal swiveling axis on the base side. The appliance door can have been provided with a recessed grip for opening and closing the dishwasher.

Known from DE 199 07 233 A1 is a generic dishwasher in whose appliance door an operating panel is provided in which a handle shell is embodied. The handle shell has a bottom handle-shell part that is molded onto the operating panel as a single piece therewith and a handle-shell cover that is located at the back of the operating panel and by which a grip-engagement region provided by the handle shell is enclosed.

The grip-engagement region provided by the recessed grip is partially directly delimited by the back of the operating panel, as a result of which the appliance door's appearance is adversely affected as is also the feel associated with operating the door. In the region of the handle shell it is in addition not possible to use the back of the operating panel for locating control electronics for said panel's display and control elements.

BRIEF SUMMARY OF THE INVENTION

The object of the invention is to provide a domestic appliance having an appliance door whose handle shell is embodied as being stable and also appealing in terms of appearance and feel.

Said object is achieved by means of the features of the invention. Advantageous developments of the invention are disclosed in the subclaims.

The invention proceeds from a domestic appliance, in particular a dishwasher, having an appliance door that has an operating panel with a handle shell formed from at least one bottom handle-shell part and a handle-shell cover.

According to the characterizing part of claim 1, the handle-shell cover has a side wall that faces the operating panel and together with the operating panel forms a double-wall structure having an intermediately located free installation space. The double-wall structure will give a user engaging with the handle shell the impression of sound design and good quality. Engaging behind just a single thickness of plastic material as is the case with the prior art can hence advantageously be avoided.

An electronic module for the control or display elements on the operating panel can additionally be located in the free installation space between the operating panel and handle-shell cover's side wall. Directly above the handle shell's grip-engagement opening in the operating panel's front wall it is in that way possible to provide a display window for a display projecting at least partially above the grip-engagement opening in the appliance door's upward direction.

The fully assembled appliance door has a flat inside-door element that faces a useful space in the domestic appliance and can be screwed to a supporting door frame. The operating panel can have been positioned at the top edge of the appliance door on the door frame and likewise screwed to the inside-door element.

To allow the back of the operating panel to be put to favorable use in terms of structural space, the installation space in the double-wall structure can be embodied as being open toward the sides of the door in a direction parallel to the handle-shell cover's side wall or, as the case may be, to the operating panel so that a strip-shaped control module can be ducted as a single piece through the intermediate installation space across virtually the entire width of the appliance door.

The handle shell's grip-engagement opening provided in the operating panel's front wall can be delimited in the door's upward direction by a top holding bar and a bottom wall section of the operating panel, which section has been drawn upward in the shape of a dish. The holding bar and wall section form the bottom handle-shell part. The holding bar can project in the appliance door's structural-depth direction into the door's interior and join the operating panel's front wall to the handle-shell cover's side wall. The holding bar's length therefore determines the size of the double-wall structure's installation space.

The operating panel will be subjected to twisting forces when the door is opened or when the domestic appliance is lifted by its handle shell, say for transportation purposes. It is therefore of significance that the operating panel be embodied as dimensionally stable and rigid. The operating panel can against that background be roughly box- or hood-shaped in its geometry, with a front wall on the user side in which display and/or control elements are integrated and which merges into a panel covering that is bent flange-like in the structural-depth direction.

The handle-shell cover can preferably be supported on the panel covering extending along the top side or, as the case may be, on the panel roof. The handle-shell cover can for that purpose have been extended in the appliance's upward direction by at least one supporting element via which the handle-shell cover can be supported on the panel roof. The handle-shell cover or, as the case may be, its supporting element can have been dimensioned such as to be braced between the panel roof and bottom handle-shell part free from play in the mounted position. The inventive cover retention between the bottom handle-shell part and panel roof will enable the operating panel's front wall to remain free from securing elements at the back. Elements of such kind can by contrast be inventively provided on the panel roof and bottom handle-shell part. The double-wall structure's installation space will therefore likewise remain free from such securing elements.

Assembly will be made easier if the handle-shell cover can be put into its design position in a single swivel action. At least one attachment point can for that purpose have been provided on the bottom handle-shell part, possibly an open slot or an opening into which the handle-shell cover can be engaged by means of suspension hooks and then swiveled into its design position.

To secure the handle-shell cover located in its design position, the operating panel can have a securing element to prevent the handle-shell cover from being accidentally released from its design position. The securing element can preferably have been provided on the operating panel's roof. The securing element can preferably be a detent rib that engages behind the supporting element in a disassembly direction after the handle-shell cover has been swiveled into position.

If the domestic appliance is lifted by its handle shell, the handle-shell cover's supporting element will act as a force-transmitting bridge via which forces are ducted directly into the operating panel's roof without subjecting the handle-shell cover's securing elements to any strain.

Assembly will be made easier in another way if the handle-shell cover has additional lateral guide walls that can be guided along corresponding external walls of the bottom handle-shell part during installation, as a result of which the handle-shell cover will be pre-centered during installation.

BRIEF DESCRIPTION OF THE DRAWINGS

An exemplary embodiment of the invention is presented below with the aid of the attached figures, in which.

DETAILED DESCRIPTION OF EXEMPLARY EMBODIMENTS OF THE PRESENT INVENTION

Figure 1:
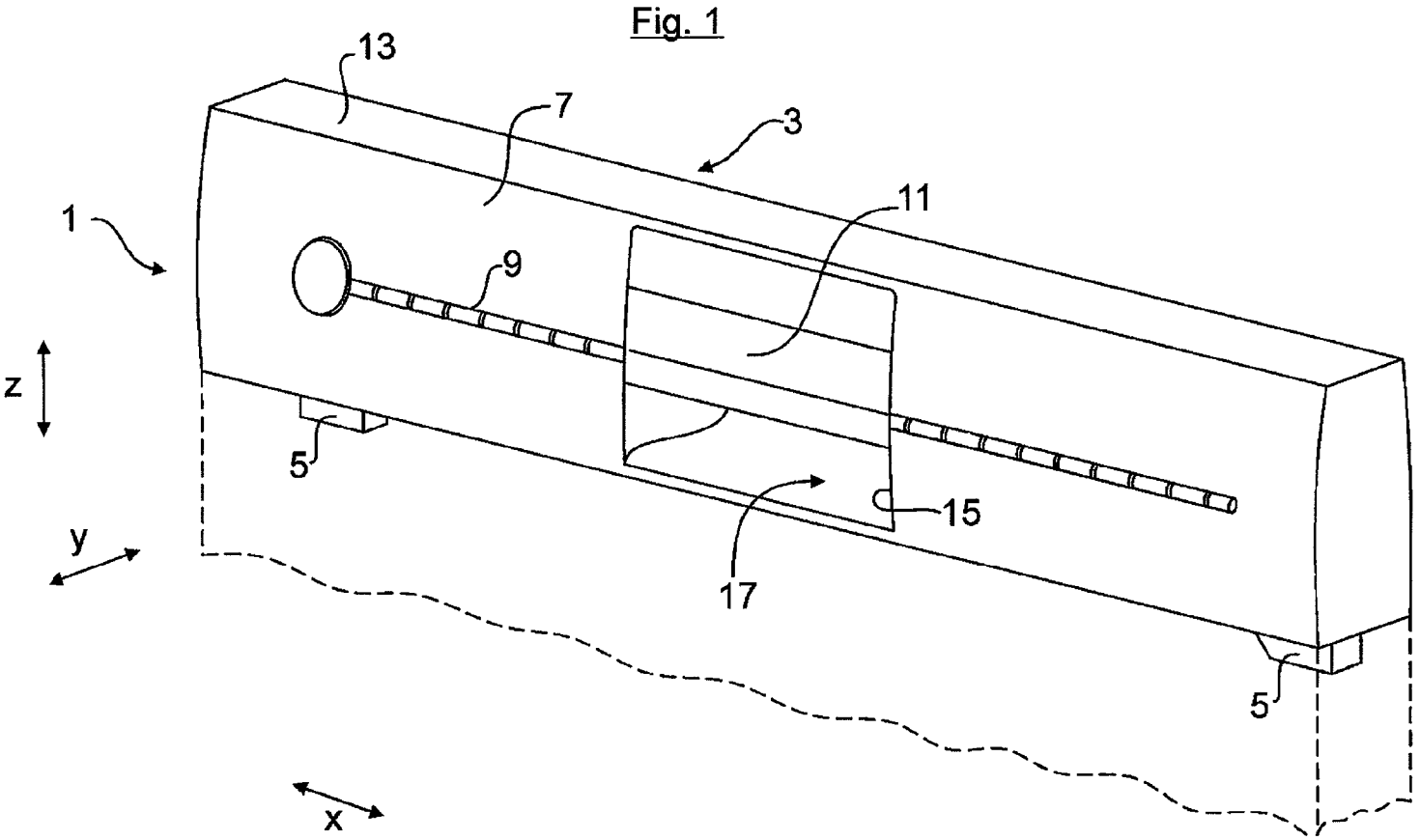
FIG. 1 shows a perspective partial view of a dishwasher's appliance door.

FIG. 1 is a partial view of a dishwasher's appliance door 1. Appliance door 1 can be operated in a known manner via a horizontal swiveling axis (not shown) on the base side and has on the top edge an operating panel 3 made of a plastic material. Operating panel 3 delimits appliance door 1 on the top side with a panel covering 13 bent flange-like and is joined via lateral, downward projecting connecting studs 5 in a manner not shown in more detail to a door structure of appliance door 1. Operating panel 3 has control elements 9 arranged in a row on its front wall 7 as well as a centrally positioned display 11 for displaying operating statuses and the like.

Front wall 7—facing the user—of operating panel 3 merges at its lateral edges situated opposite in the door-side direction x and at its top lateral edge into panel covering 13. Said covering forms a panel roof at the top door edge.

Provided below display 11 shown in FIG. 1 is a roughly rectangular grip-engagement opening 15 for a handle shell 17 integrated in operating panel 3. Handle shell 17 is according to FIG. 3 embodied as comprising two parts, namely a bottom shell part 19 and a handle-shell cover 21. Bottom handle-shell part 19 delimits insertion opening 15 of handle shell 17 with a bottom wall section 23 that has been drawn upward in the shape of a dish and an opposite, top horizontal holding bar 25. Bottom handle-shell part 19 is integrated together with its holding bar 25 and bottom wall section 23 as a single piece on operating panel 3 by injection molding. The geometry of operating panel 3 and bottom handle-shell part 19 has been selected to preclude any undercuts in the direction E in which the injection-molding tools are removed from the mold.

Figure 3:
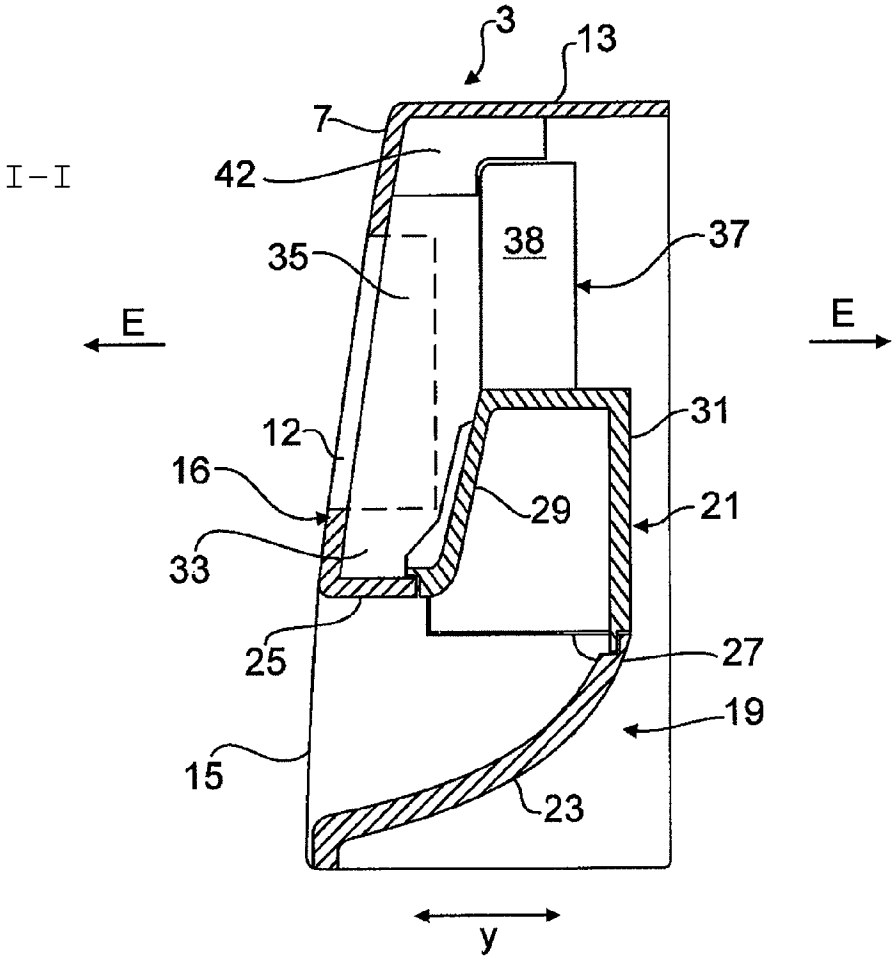
FIG. 3 shows a sectional view of the operating panel across cutting plane I-I shown in FIG. 2.

As can further be seen from FIG. 3, formed in the horizontal direction between holding bar 25 and wall section 23 that has been drawn upward is a free section bounded by an encircling contact edge 27. Seated on contact edge 27 is handle-shell cover 21. In the lateral sectional representation in FIG. 3, said cover is shown as being roughly trapezoidal with a front lateral flank 29 and rear lateral flank 31 each in contact with holding bar 25 or, as the case may be, upward-drawn wall section 23 of bottom handle-shell part 19. Together with the operating panel's front wall 7, lateral flank 29 of handle-shell cover 21 forms in the region above grip-engagement opening 15 a double-wall structure 16 having a diagonally arranged holding bar 25. Said bar joins the two walls, which is to say front wall 7 and lateral flank 29, to each other. Situated between lateral flank 29 of handle-shell cover 21 and front wall 7 of operating panel 3 is a free intermediate installation space 33 through which, according to the figures, an electronic module 35 (indicated only by dashed lines) has been ducted along the back of operating panel 3. The size of installation space 33 in the structural-depth direction 4 is determined by the length of holding bar 25.

Electronic module 35 has been assigned to control and display elements 9, 11 of operating panel 3. Electronic module 35 is according to FIG. 2 embodied as strip-shaped and has been ducted through installation space 33 of double-wall structure 16. Electronic module 35 thus extends across virtually the entire width of appliance door 1.

Figure 2:
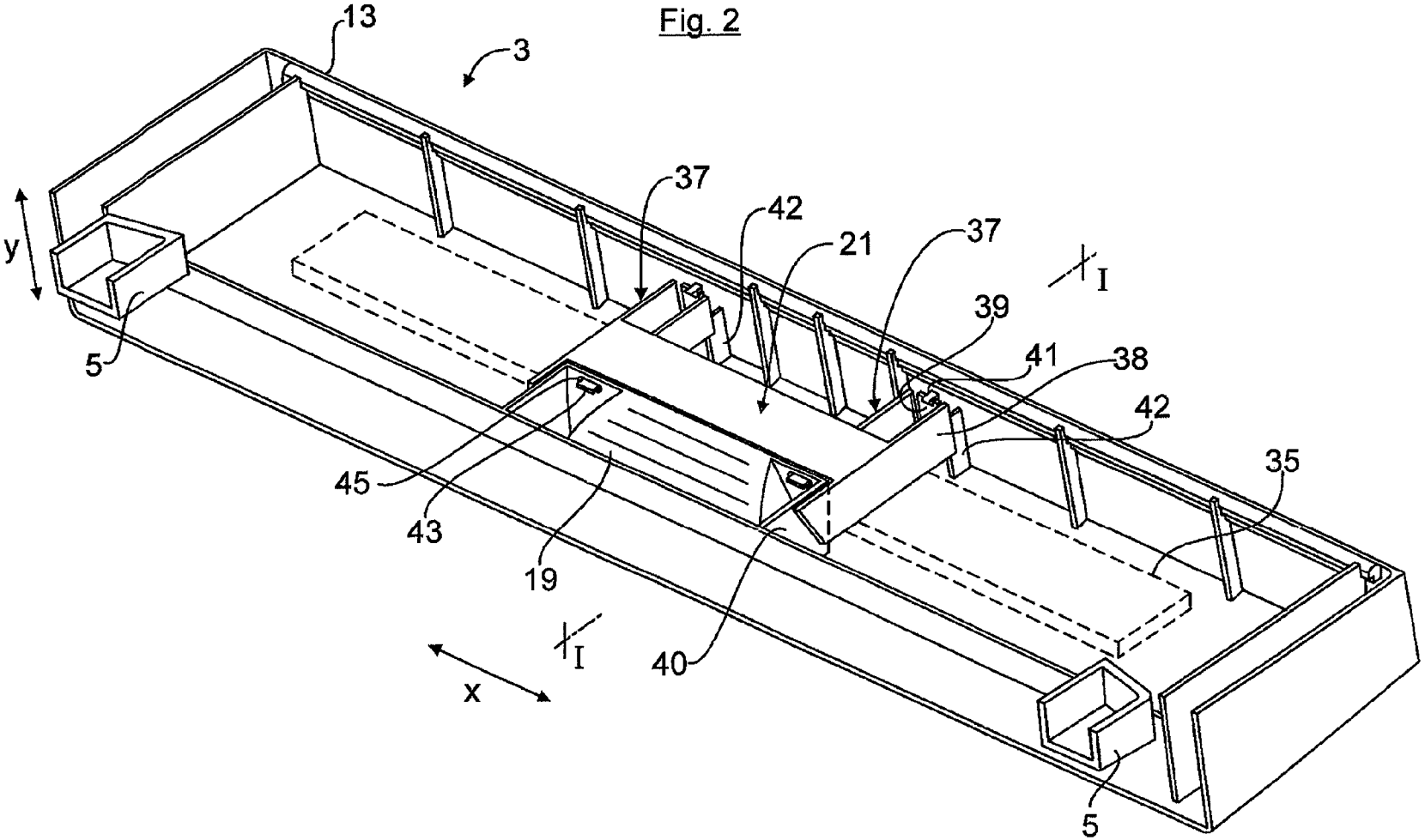
FIG. 2 shows a rear view of the appliance door's operating panel in isolation.

As can further be seen from FIGS. 2 and 3, handle-shell cover 21 is supported via lateral supporting elements 37 on supporting ribs 39. Supporting elements 37 embodied roughly in the manner of a shaft are dimensioned such that handle-shell cover 21 will in the mounted position shown be braced free from play between supporting ribs 42 and contact edge 27 of bottom handle-shell part 19. According to the figures supporting ribs 42 are molded on the back of panel roof 13.

According to FIG. 2 each of supporting elements 37 has two shaft walls 38 that are connected to each other at the end face via an elastically flexible detent wall 39.

According to FIG. 3, shaft walls 38 of supporting elements 37 rest in the design position on a contact shoulder of supporting ribs 42 in a form-fit manner. When handle-shell cover 21 is swiveled into position according to FIG. 4, elastically flexible detent walls 39 of supporting elements 37 will be ducted past detent ribs 41. Detent walls 39 will therein be bent elastically out of their rest position. Detent walls 39 will spring back to their rest position when handle-shell cover 21 is in the design position, as a result of which detent rib 41 will engage behind detent walls 39. Handle-shell cover 21 will in that way be held firmly in the design position shown.

It is described below with the aid of FIG. 4 how handle-shell cover 21 is mounted on operating panel 3. Handle-shell cover 21 is accordingly swiveled in a single swivel action I into its design position shown in FIG. 2. Handle-shell cover 21 has lateral suspension hooks 43 for performing the swivel action. Said hooks are according to FIG. 4 ducted through lateral opening 45 on bottom handle-shell part 19, as a result of which an articulated joint will be formed via which handle-shell cover 21 can be swiveled into the design position.

Figure 5:
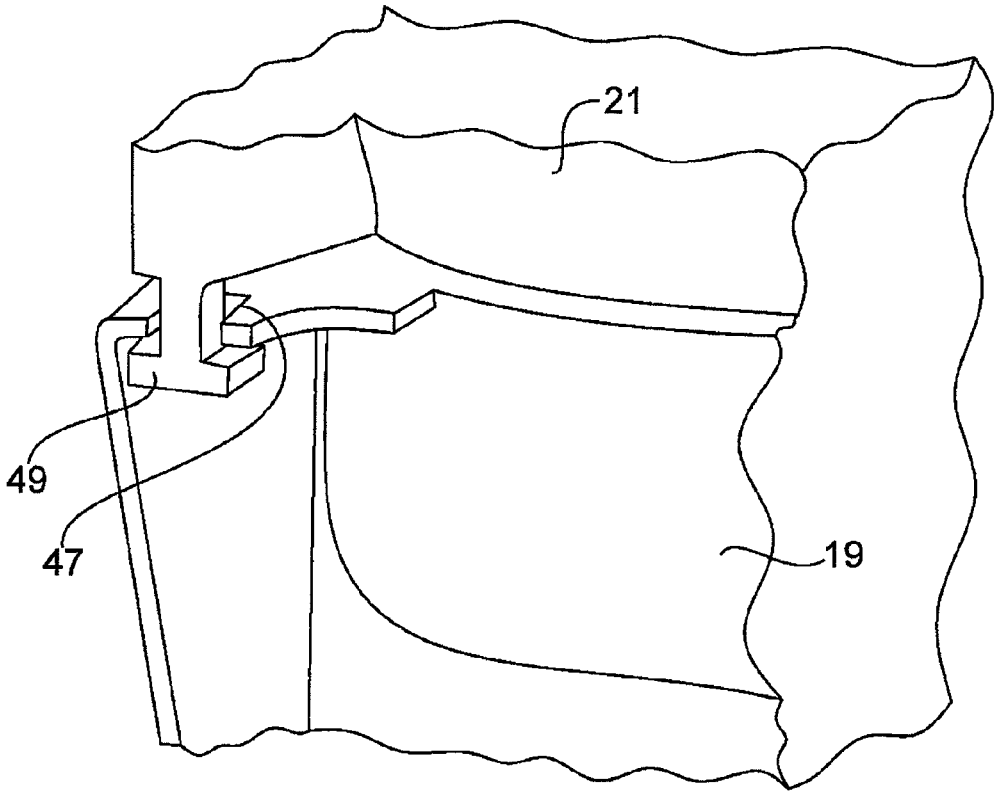
FIG. 5 shows an attachment point on the bottom handle-shell part for mounting the handle-shell cover in a variation.

An alternative implementation of bottom handle-shell part 19 is shown in FIG. 5 as a variation. Bottom handle-shell part 19 accordingly does not have any lateral openings 45 into which suspension hooks 43 can be inserted from above. The articulated joint is in contrast to the preceding figures implemented by way of a guide slot 47 that is open in the structural-depth direction and a T-shaped suspension strap 49 that can be pushed into it and is molded on handle-shell cover 21.

Figure 4:
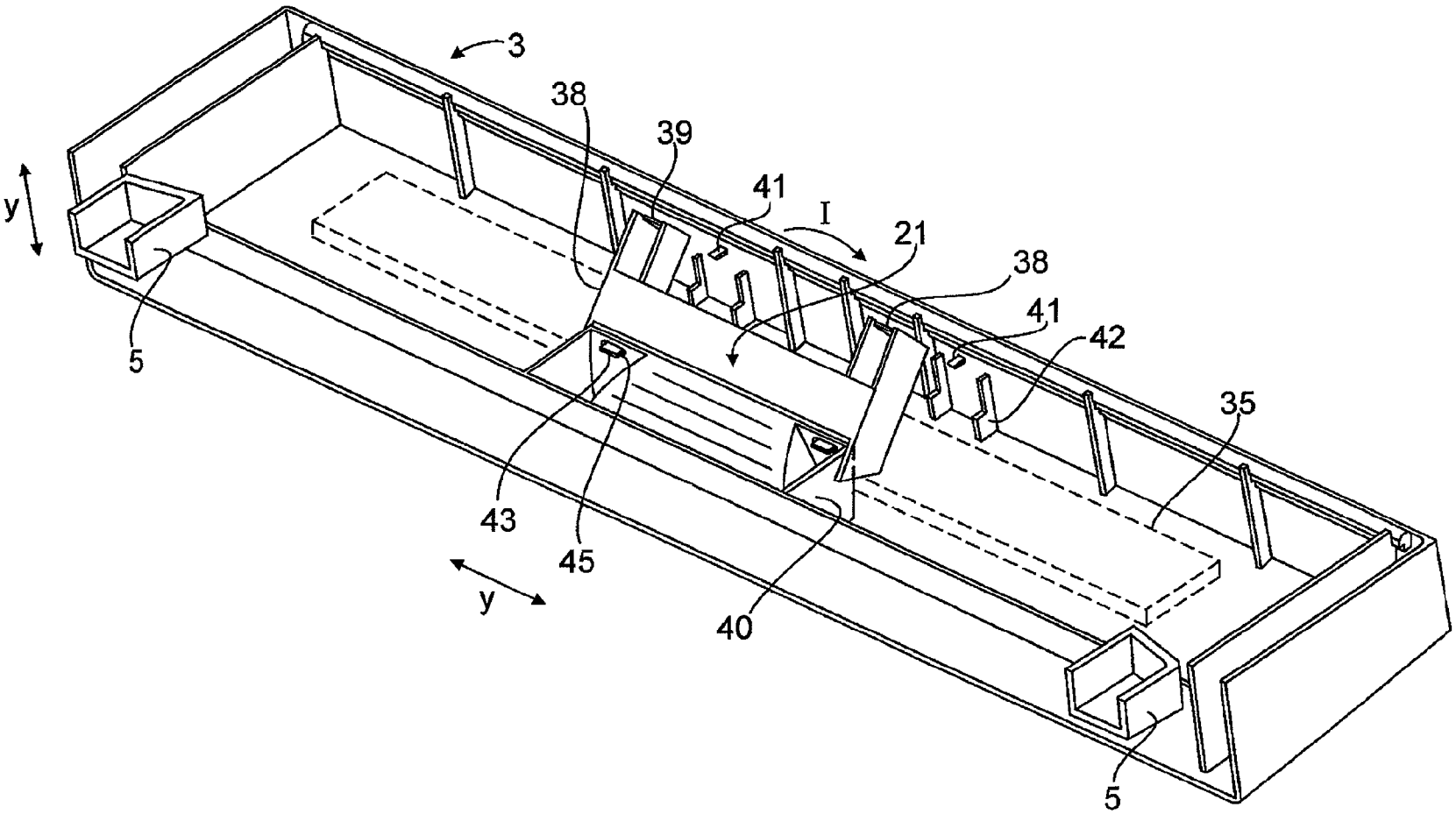
FIG. 4 shows a view corresponding to FIG. 2 for illustrating how the handle-shell cover is mounted.

In each case the laterally outer shaft walls 38 of supporting elements 37 are according to FIGS. 2 and 4 extended downward such as to overlap laterally outer walls 40 of bottom handle-shell part 19. Laterally downwardly extended shaft walls 38 thus serve as guide walls by means of which the swivel action is guided toward the sides of the appliance.

LIST OF REFERENCES

| | |
|---|---|
| 1 | Appliance door |
| 3 | Operating panel |
| 5 | Connecting neck ends |
| 7 | Front wall of operating panel 3 |
| 9 | Control elements |
| 11 | Display |

-continued

| LIST OF REFERENCES | |
|---|---|
| 13 | Panel roof |
| 15 | Grip-engagement opening |
| 17 | Handle shell |
| 19 | Bottom handle-shell part |
| 21 | Handle-shell cover |
| 23 | Drawn-up wall section |
| 25 | Holding bar |
| 27 | Contact edge |
| 29 | Front lateral flank |
| 31 | Rear lateral flank |
| 33 | Installation space |
| 35 | Electronic module |
| 37 | Supporting elements |
| 38 | Supporting walls |
| 39 | Detent wall |
| 41 | Detent ribs |
| 42 | Supporting ribs |
| 43 | Suspension hooks |
| 45 | Opening |
| 47 | Guide slot |
| 49 | T-shaped suspension strap |
| 40 | Side walls of handle shell 17 |
| E | Direction of removal from mold |
| I | Direction of swivel action |
| x | Direction toward the sides of the appliance |
| y | Structural-depth direction |
| z | Vertical direction |

The invention claimed is:

1. An operating panel for a door of a domestic appliance, comprising:

a front wall; and a handle shell defining a grip recess to be gripped by a user, the handle shell formed from at least one bottom handle-shell part and a handle-shell cover, wherein the handle-shell cover is attached to the at least one bottom handle-shell part in an assembled position, wherein said handle-shell cover has a front lateral flank that faces the front wall of the operating panel, and wherein the front wall and the front lateral flank form a double-wall structure defining, at least in part, an installation space.

2. The operating panel of claim 1, further comprising an electronic module configured to interact with control or display elements of the operating panel, said electronic module being located in the installation space of the double-wall structure.

3. The operating panel of claim 1, wherein the installation space is open toward a side of the operating panel in a direction parallel to a longitudinal axis of the front lateral flank of the handle-shell cover or to a longitudinal axis of the operating panel.

4. The operating panel of claim 1, wherein display and/or control elements are integrated in the front wall, and wherein the operating panel further comprises a panel roof extending away from the front wall at an angle in the form of a flange.

5. The operating panel of claim 4, wherein the handle-shell cover is supported between the bottom handle-shell part and the panel roof.

6. The operating panel of claim 4, wherein the handle-shell cover has at least one supporting element via which the handle-shell cover is supported on the panel roof.

7. The operating panel of claim 1, wherein the bottom handle-shell part has at least one attachment point for attachment of the handle-shell cover in the assembled position.

8. The operating panel of claim 7, wherein the bottom handle-shell part further comprises an open slot or an opening at the attachment point.

9. The operating panel of claim 1, further comprising a securing element structured to secure the handle-shell cover in the assembled position.

10. The operating panel of claim 9, wherein the securing element is provided on a panel roof of the operating panel.

11. The operating of claim 9, further comprising a supporting element structured to support the handle-shell cover, wherein said securing element is structured as a detent element to engage the supporting element in the assembled position.

12. The operating panel of claim 1, wherein the front wall of the operating panel has a display window above an opening of the grip recess of the handle shell.

13. The operating panel of claim 1, wherein the handle-shell cover has lateral guide walls structured to engage corresponding external walls of the bottom handle-shell part the assembled position.

14. The operating panel of claim 1, wherein the operating panel has a holding bar that connects the front wall of the operating panel to the front lateral flank of the handle-shell cover.

15. The operating panel of claim 14, wherein the holding bar partly delimits the grip recess of the handle shell.

16. The operating panel of claim 1, wherein the at least one bottom handle-shell part is formed in one piece with the operating panel.

17. The operating panel of claim 16, wherein the handle-shell cover comprises a separate component structured to be joined with the at least one bottom handle-shell part to, at least in part, form the handle shell and define the grip recess.

18. The operating panel of claim 1, wherein the operating panel further comprises a holding bar extending away from the front wall, the at least one bottom shell panel further comprises a wall section, and the handle-shell cover further comprises a rear lateral flank, wherein the holding bar and the wall section define a contact edge, and wherein the front lateral flank is structured to be attached to the holding bar at the contact edge and the rear lateral flank is structured to be attached to the wall section at the contact edge.

19. The operating panel of claim 1, wherein the at least one bottom handle-shell part is curved.

20. A door for a domestic appliance, further comprising the operating panel of claim 1.

21. A domestic appliance, further comprising the door of claim 20.

22. The operating panel of claim 21, constructed in the form of a dishwasher.

* * * * *